US006222308B1

(12) United States Patent
Ozawa et al.

(10) Patent No.: US 6,222,308 B1
(45) Date of Patent: Apr. 24, 2001

(54) EMITTER MATERIAL FOR CATHODE RAY TUBE HAVING AT LEAST ONE ALKALINE EARTH METAL CARBONATE DISPERSED OR CONCENTRATED IN A MIXED CRYSTAL OR SOLID SOLUTION

(75) Inventors: Tetsuro Ozawa, Kyoto; Yoshiki Hayashida; Hiroshi Sakurai, both of Osaka, all of (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 08/716,019

(22) Filed: Sep. 19, 1996

(30) Foreign Application Priority Data

Sep. 21, 1995 (JP) ..... 7-243047
Aug. 7, 1996 (JP) ..... 8-208518

(51) Int. Cl.[7] ..... H01J 1/14; H01J 19/06; H01J 9/04; H01K 1/04

(52) U.S. Cl. ..... 313/346 R; 313/346 DC; 445/51; 445/50

(58) Field of Search ..... 313/309–310, 313/336, 351, 346 DC, 346 R, 495, 270, 409–411, 337; 445/51, 9–12, 14

(56) References Cited

U.S. PATENT DOCUMENTS

| | | | | |
|---|---|---|---|---|
| 1,870,951 | | 8/1932 | Fredenburgh . | |
| 2,703,790 | | 3/1955 | Anderson | 252/521 |
| 2,912,611 | * | 11/1959 | Beck et al. | 313/346 R |
| 4,797,593 | | 1/1989 | Saito et al. . | |
| 4,924,137 | | 5/1990 | Watanabe et al. . | |
| 5,055,078 | | 10/1991 | Lee et al. . | |
| 5,059,856 | | 10/1991 | Derks . | |
| 5,347,194 | | 9/1994 | Derks | 313/346 |
| 5,548,184 | * | 8/1996 | Choi et al. | 313/346 R |
| 5,684,357 | * | 11/1997 | Lee et al. | 313/346 R |
| 5,698,937 | * | 12/1997 | Ju et al. . | |

FOREIGN PATENT DOCUMENTS

| | | |
|---|---|---|
| 0 330 355 | 8/1989 | (EP) . |
| 0 373 701 | 6/1990 | (EP) . |
| 0 482 704 | 4/1992 | (EP) . |
| 869892 | 2/1942 | (FR) . |
| 1029729 | 6/1953 | (FR) . |
| 182817 | 8/1923 | (GB) . |
| 663981 | 1/1952 | (GB) . |
| 700313 | 11/1953 | (GB) . |
| 63-257153 | 10/1988 | (JP) . |
| 1-315926 | 12/1989 | (JP) . |
| 62-22347 | 1/1997 | (JP) . |

OTHER PUBLICATIONS

Bol'Shakov, et al., "Phase imhomogeneity of mixed crystals of alkaline earth carbonates and its influence on the propertie of oxide cathodes", *Inorganic Materials*, vol. 13, No. 5, May 1977, pp. 1025–1028.

* cited by examiner

*Primary Examiner*—Nimeshkumar D. Patel
*Assistant Examiner*—Mack Haynes
(74) *Attorney, Agent, or Firm*—Merchant, Gould, Smith, Edell, Welter & Schmidt, P.A.

(57) ABSTRACT

An emitter material for a CRT comprises mixed crystal or solid solution of at least two kinds of alkaline earth metal carbonate, wherein at least one alkaline earth metal carbonate is dispersed or separated in the mixed crystal or solid solution. The alkaline earth metal carbonate, which is an emitter material for the CRT, is coated onto the base metal and thermally decomposed in a vacuum to from an emitter of an alkaline earth metal. This emitter, which is proper for a larger screen size, high brightness and high resolution CRT, can be provided with enough life characteristics even under the operating condition of the emission current density of $2A/cm^2$.

21 Claims, 20 Drawing Sheets

EMITTER MATERIAL FOR CATHODE RAY TUBE HAVING AT LEAST ONE ALKALINE EARTH METAL CARBONATE DISPERSED OR CONCENTRATED IN A MIXED CRYSTAL OR SOLID SOLUTION

FIELD OF THE INVENTION

This invention relates to an emitter material for a cathode ray tube (CRT) used in television, a display or the like.

BACKGROUND OF THE INVENTION

Conventionally, alkaline earth metal carbonate for a cathode ray tube has been synthesized by adding sodium carbonate aqueous solution or ammonium carbonate aqueous solution into a binary mixed aqueous solution comprising barium nitrate and strontium nitrate, or a ternary mixed aqueous solution comprising above-mentioned binary mixed aqueous solution and calcium nitrate, at a predetermined addition rate and reacting therewith to thus precipitate binary (Ba, Sr) carbonate or ternary (Ba, Sr, Ca) carbonate. The method includes, for example, a sodium carbonate precipitating method. This sodium carbonate precipitating method represents synthesizing alkaline earth metal carbonate by adding a sodium carbonate aqueous solution as a precipitant into a binary mixed nitrate aqueous solution comprising barium nitrate and strontium nitrate or a ternary mixed nitrate aqueous solution comprising barium nitrate, strontium nitrate and calcium nitrate. The method using the binary solution is shown in the following Chemical Formula 1 and the method using the ternary solution is shown in the following Chemical Formula 2.

$$(Ba, Sr)\ (NO_3)_2+Na_2CO_3 \rightarrow (Ba, SR)CO_3+2NaNO_3 \qquad \text{Formula 1}$$

$$(Ba, Sr, Ca)\ (NO_3)_2+Na_2CO_3 \rightarrow (Ba, Sr, Ca)CO_3+2Na\ NO_3 \qquad \text{Formula 1}$$

When the binary carbonate and ternary carbonate synthesized by the sodium carbonate precipitating method are analyzed by X-ray (wave length is 0.154 nm) diffraction analysis, the diffraction patterns are obtained as in FIG. 18 and FIG. 19. According to FIG. 18 and FIG. 19, there is observed to be one peak respectively in a part of the interplanar spacing ranging from 0.33 nm to 0.40 nm or in the part of a diffraction angle ranging from 22 to 27° (the part between the two dotted lines in FIG. 18 and FIG. 19). The number of the peak does not change regardless of how the synthesizing condition such as reaction temperature or concentration of the aqueous solution or the like is changed during synthesis of carbonate. Moreover, if sodium carbonate is replaced by ammonium carbonate, the same result can be obtained.

Next, yttrium oxide is added into the above mentioned alkaline earth metal carbonate in an amount of 630 wt.ppm to make a mixture. Then, this mixture is dispersed into a solution in which a small amount of nitrocellulose is added into a mixture medium containing diethyl oxalate and diethyl acetate to make a dispersion solution. This dispersion solution is coated onto the cathode base and thermally decomposed under vacuum to make an emitter for a cathode containing alkaline earth metal oxide as a main component. Then, the relationships between the operating time and the emission current remaining ratio at the current densities of $2A/cm^2$ and $3A/cm^2$ are shown in FIG. 20. The line "a" represents the relation in the case where the binary carbonate is employed for an emitter and the current density is $2A/cm^2$. The line "b" represents the relationship in the case where the ternary carbonate is employed for an emitter and the current density is $2A/cm^2$. The line "d" represents the relationship in the case where the binary carbonate is employed for an emitter and the current density is $3A/cm^2$. The line "e" represents the relationship in the case where the ternary carbonate is employed for an emitter and the current density is $3A/cm^2$. The emission current remaining ratio is the normalized value of the emission current with respect to the operating time based on the initial value of the emission current as 1 (the ratio of the emission current with respect to the operating time in the case of setting the initial value of the emission current as 1), and it can be said that the larger the emission current remaining ratio, the better the emission characteristic. As is apparent from FIG. 20, in the operations at the current density of $3A/cm^2$, the emission current remaining ratio is quite low in both binary and ternary carbonate. It can be said that the allowed value of the current density of these emitters is approximately $2A/cm^2$.

Recently, as a CRT has a larger screen size, higher brightness and higher resolution, the higher density of emission current has been demanded. However, if the conventional emitter materials for CRTs are used at the current density above $2A/cm^2$, a sufficient lifetime cannot be maintained. Thus, the conventional emitter materials cannot be employed for a CRT that is aiming at a larger screen size, higher brightness and higher resolution.

THE SUMMARY OF THE INVENTION

The object of the present invention is to provide an emitter material for a CRT aiming at a larger screen size, higher brightness, and higher resolution.

In order to obtain the above-mentioned object, the emitter materials for a CRT of the present invention comprise mixed crystal or solid solution of at least two kinds of alkaline earth metal carbonate, wherein at least one alkaline earth metal carbonate is dispersed or separated in the mixed crystal or solid solution. The mixed crystal or solid solution herein denotes the crystalline solid containing not less than two kinds of salts. Moreover, the dispersion herein denotes the state where mixed crystal or solid solution particles and general salt crystalline particles are mixed. The separation denotes the state where each of the same kind of components distribute locally in groups in one crystal of carbonate.

It is preferable in the above-mentioned composition in which at least one alkaline carbonate is dispersed in the above mentioned mixed crystal or solid solution that the average particle size of the crystalline particles dispersed in the mixed crystal or solid solution is not less than one-third nor more than three times as large as the average particle size of the above-mentioned mixed crystal or solid solution. The average particle size herein represents the average value of individual diameters in the direction of the long axis (in the case of spherical crystal, the average value of the diameter) of the crystalline particles.

It is preferable in the above-mentioned composition that the average size of the crystalline particles is in the range from 2 to 5 $\mu$m.

It is preferable in the above-mentioned composition that an X-ray diffraction pattern of alkaline earth metal carbonate has two peaks or more in the interplanar spacing ranging from 0.33 nm to 0.40 nm.

The other means for analysis and identification includes the means of analyzing the distributional state of Ba, Sr and Ca in the crystalline particles of carbonate that is an emitter material by the use of an X-ray microanalyzer.

It is preferable in the above-mentioned composition that the at least two kinds of alkaline earth metal carbonate comprise barium carbonate and strontium carbonate.

It is preferable in the above-mentioned composition that the alkaline earth metal carbonate comprising barium carbonate and strontium carbonate is dispersed or separated in an amount of not less than 0.1 to less than 70 wt. %.

It is preferable in the above-mentioned composition that the at least two kinds of alkaline earth metal carbonate comprise three kinds of carbonate; barium carbonate, strontium carbonate and calcium carbonate.

It is preferable in the above-mentioned composition that alkaline earth metal carbonate comprising three kinds of carbonate; barium carbonate, strontium carbonate and calcium carbonate is dispersed and separated in an amount of not less than 0.1 wt. % to less than 60 wt. %.

It is preferable in the above-mentioned composition that the emitter material for a CRT further comprises at least one material selected from the group consisting of rare earth metal, rare earth metal oxide and rare earth metal carbonate.

It is preferable in the above-mentioned composition that yttrium atoms are added into the emitter material for a CRT by the coprecipitation method in an amount of 550–950 ppm with respect to the number of alkaline earth metal atoms.

According to the method for manufacturing emitter materials for a CRT of the present invention, at least two kinds of alkaline earth metal nitrate aqueous solution are added individually into an aqueous solution including carbonic acid ion at different addition rates to react therewith.

It is preferable in the above-mentioned method that at least one kind of alkaline earth metal carbonate is dispersed as crystalline particles in the mixed crystal or solid solution particles, and that the average particle size of the crystalline particles is not less than one-third times nor more than three times as large as the average particle size of the mixed crystal or solid solution.

It is preferable in the above-mentioned method that at least one kind of alkaline earth metal carbonate is dispersed as crystalline particles in the mixed crystal or solid solution and the average particle size of the crystalline particles is in the range from 2 to 5 $\mu$m.

It is preferable in the above-mentioned method that an X-ray diffraction pattern of alkaline earth metal carbonate has two peaks or more in the interplanar spacing ranging from 0.33 nm to 0.40 nm.

It is preferable in the above-mentioned method that the at least two kinds of alkaline earth metal carbonate comprise barium carbonate and strontium carbonate.

It is preferable in the above-mentioned method that the alkaline earth metal carbonate comprising barium carbonate and strontium carbonate is dispersed or separated in an amount of not less than 0.1 to less than 70 wt. %.

It is preferable in the above-mentioned method that the at least two kinds of alkaline earth metal carbonate comprise barium carbonate, strontium carbonate and calcium carbonate.

It is preferable in the above-mentioned method that in an emitter material for a CRT comprising three kinds of carbonate; barium carbonate, strontium carbonate and calcium carbonate, the alkaline earth metal carbonate is dispersed or separated in an amount of not less than 0.1 wt. % to less than 60 wt. %.

It is preferable in the above-mentioned method that an emitter material for a CRT comprises at least one material selected from the group consisting of rare earth metal, rare earth metal oxide and rare earth metal carbonate.

It is preferable in the above-mentioned method that yttrium atoms are added by the coprecipitation method in an amount of 550–950 ppm with respect to the number of alkaline earth metal atoms used for forming emitter material.

According to the present invention, at least one kind of alkaline earth metal carbonate is distributed locally in a mixed crystal or solid solution of alkaline earth metal carbonate so that the emitter material for a CRT can be provided with enough life characteristics even when used with an emission current of more than 2A/cm$^2$, for example, 3A/cm$^2$. Moreover, the emitter material of the present invention permits a larger screen size, high brightness and high resolution. The emission slump can be inhibited by making the average particle size of dispersed alkaline earth metal carbonate be within the above-mentioned range. The emission slump herein represents the phenomenon where the emission current gradually decreases during the time of a few seconds to a few minutes at the beginning of electron emission until the emission current stabilization. In addition, an emitter material for a CRT that can realize these characteristics has an X-ray diffraction pattern for alkaline earth metal carbonate having two peaks or more in the interplanar spacing ranging from 0.33 nm to 0.40 nm.

In the case where crystalline particles of alkaline earth metal carbonate are synthesized by adding at least two kinds of alkaline earth metal nitrate aqueous solution into an aqueous solution comprising carbonic acid ions individually at different addition rates, at least one kind of alkaline earth metal carbonate is separated in a crystalline particle of carbonate so that the emitter material for a CRT can be provided with enough life characteristics even when operated with an emission current of more than 2A/cm$^2$, for example, 3A/cm$^2$. Moreover, the emitter material of the present invention permits a larger screen size, high brightness and high resolution.

In any of above mentioned cases, in the case where the elements of alkaline earth metal carbonate crystalline particle comprises barium carbonate and strontium carbonate or comprises barium carbonate, strontium carbonate and calcium carbonate, the good emission characteristics can be obtained and also a larger screen size , higher brightness and higher resolution of the CRT can be realized.

Moreover, in any of above mentioned cases, the good emission characteristics can be obtained and a larger screen size, high brightness and a high resolution can be realized by adding at least one selected from the group consisting of rare earth metal, rare earth metal oxide and rare earth metal carbonate. Furthermore, ytrrium atoms can be added in an amount of 550–950 ppm with respect to the number of atoms of alkaline earth metal making an emitter material by the coprecipitation method. As compared with the case where no yttrium atoms are added, the thermal decomposition temperature decreased by approximately 100° C., thus reducing the thermal decomposition time as well as the manufacturing cost.

Moreover, the present invention permits manufacturing emitter materials for a CRT effectively.

DETAILED DESCRIPTION

The invention will be explained in detail with reference to the attached figures and the following examples.

Figure 1:
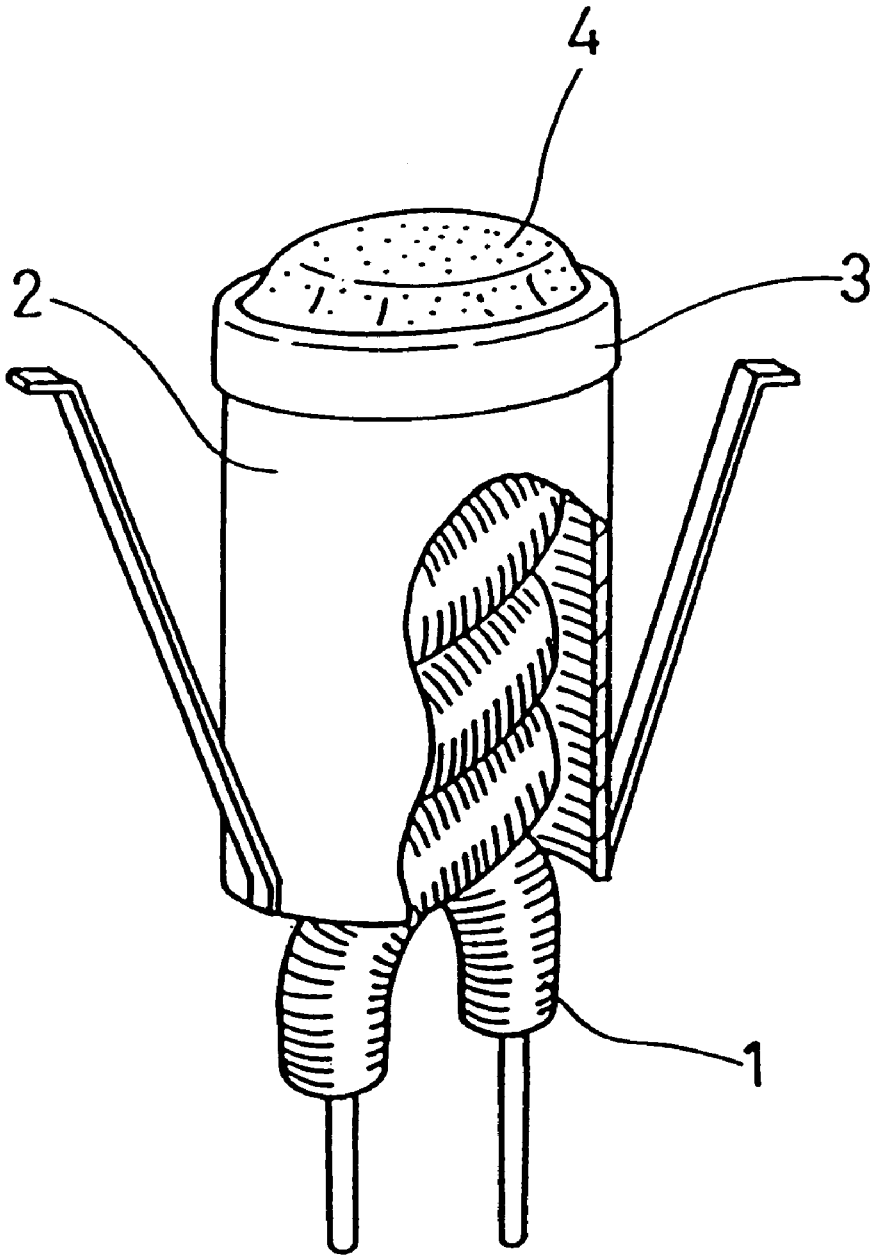
FIG. 1 is a partial cutaway view of a cathode of the color CRT tube of the first example of the present invention.

FIG. 1 shows the basic structure of the cathode comprising an emitter material for the CRT of one embodiment of the present invention. The above mentioned cathode comprises a helical filament 1, a cylindrical sleeve 2, a cap-like base 3 and an emitter 4. The cylindrical sleeve 2 made of nickel chrome alloy contains the helical filament 1. The cap-like base 3 made of nickel tungsten alloy containing a trace amount of magnesium is provided at the end opening portion of the cylindrical sleeve 2. The emitter 4, which is an emitter material for the CRT, is coated onto the base 3. The emitter 4 comprises a mixed crystal or solid solution of at least two kinds of alkaline earth metal carbonate. In the above mentioned mixed crystal or solid solution, at least one alkaline earth metal carbonate is dispersed or separated. This alkaline earth metal carbonate is thermally decomposed in a vacuum to form an alkaline earth metal carbonate oxide layer.

The present invention will be explained more specifically with reference to the following embodiments.

EXAMPLE 1

Referring now to figures, there are illustrated the first embodiment of the present invention.

Figure 18:
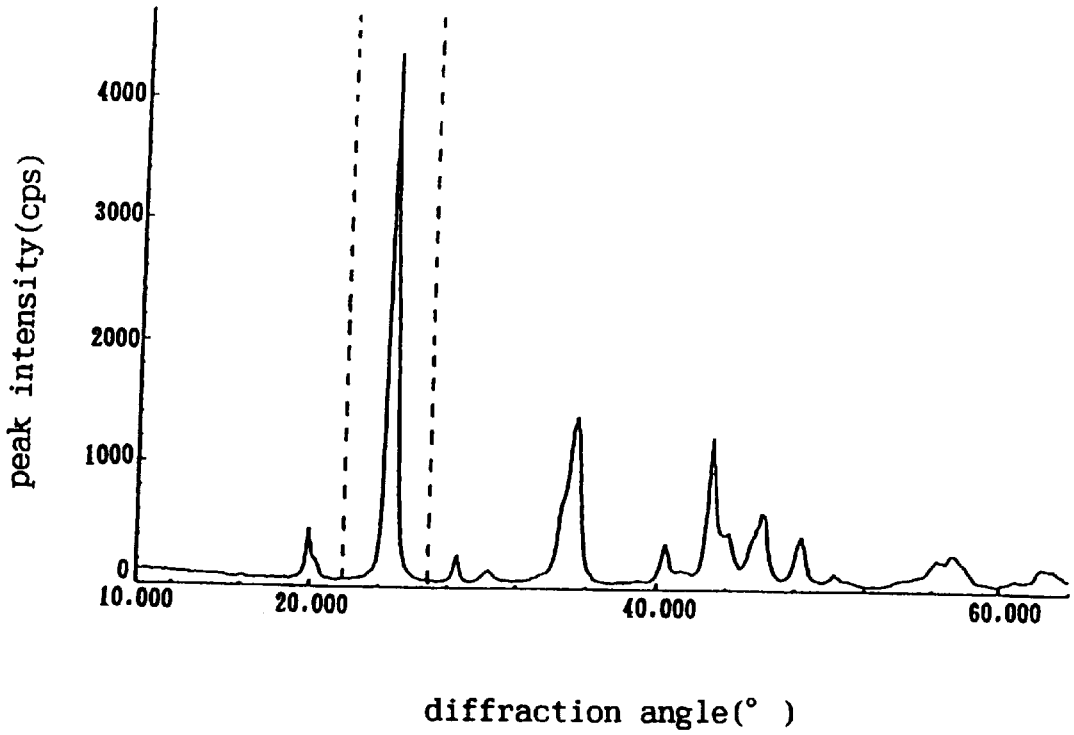
FIG. 18 is a diagram illustrating an X-ray diffraction pattern of the binary alkaline earth metal carbonate that is a material for the cathode of the prior art 1.

Binary carbonate, which was synthesized by the sodium carbonate precipitation method and shows the X-ray diffraction pattern as shown in FIG. 18, and $BaCO_3$ were mixed at the weight ratio of 2:1, thus making a mixed carbonate A. Then, the above mentioned binary carbonate and $SrCO_3$ were mixed with the weight ratio of 2:1, thus making a mixed carbonate B. Further, the above mentioned binary carbonate, $BaCO_3$ and $SrCO_3$ were mixed at the weight ratio of 4:1:1, thus making a mixed carbonate C.

The above mentioned binary carbonate was obtained through the following steps of: dissolving 5 kilograms of barium nitrate and 4 kilograms of strontium nitrate in 100 liters of hot water at a temperature of 80° C. (This aqueous solution is designated as "solution W" for ease of reference.); dissolving 8 kilograms of sodium carbonate in hot water at a temperature of 80° C. (This aqueous solution is designated as "solution X" for ease of reference.); stirring the solution W and keeping it at the temperature of 80° C.; adding the solution X into the solution W at the addition rate of 2 liters per minute by the use of a pump to form a precipitate of $(Ba, Sr)CO_3$; separating this carbonate by the centrifugal method; and then drying this carbonate at a temperature of 140° C.

Figure 2:
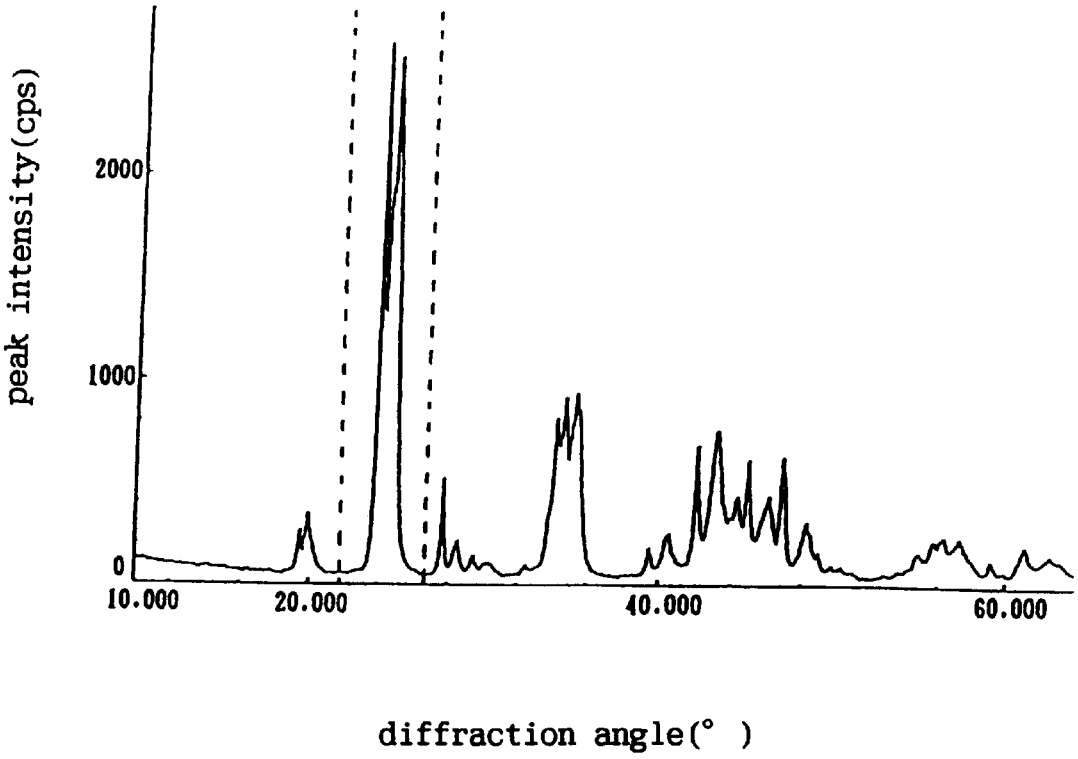
FIG. 2 is a diagram illustrating an X-ray diffraction pattern of the mixed carbonate A that is a material for the cathode of the first example of the present invention.
Figure 3:
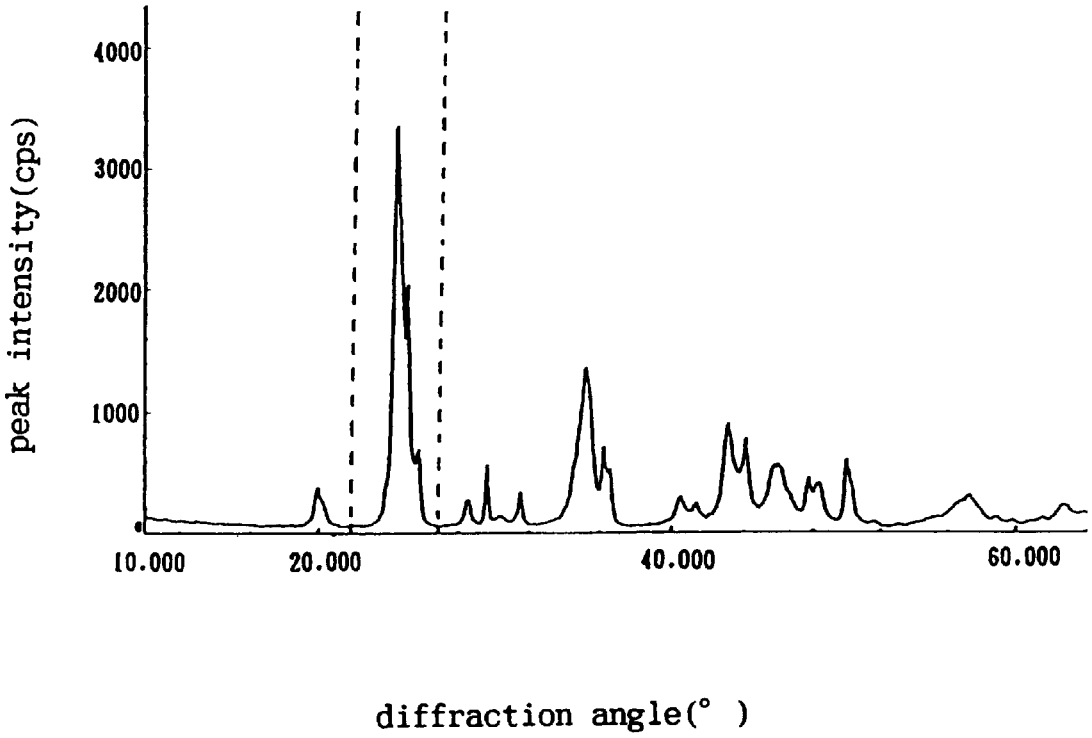
FIG. 3 is a diagram illustrating an X-ray diffraction pattern of the mixed carbonate B that is a material for the cathode of the first example of the present invention.
Figure 4:
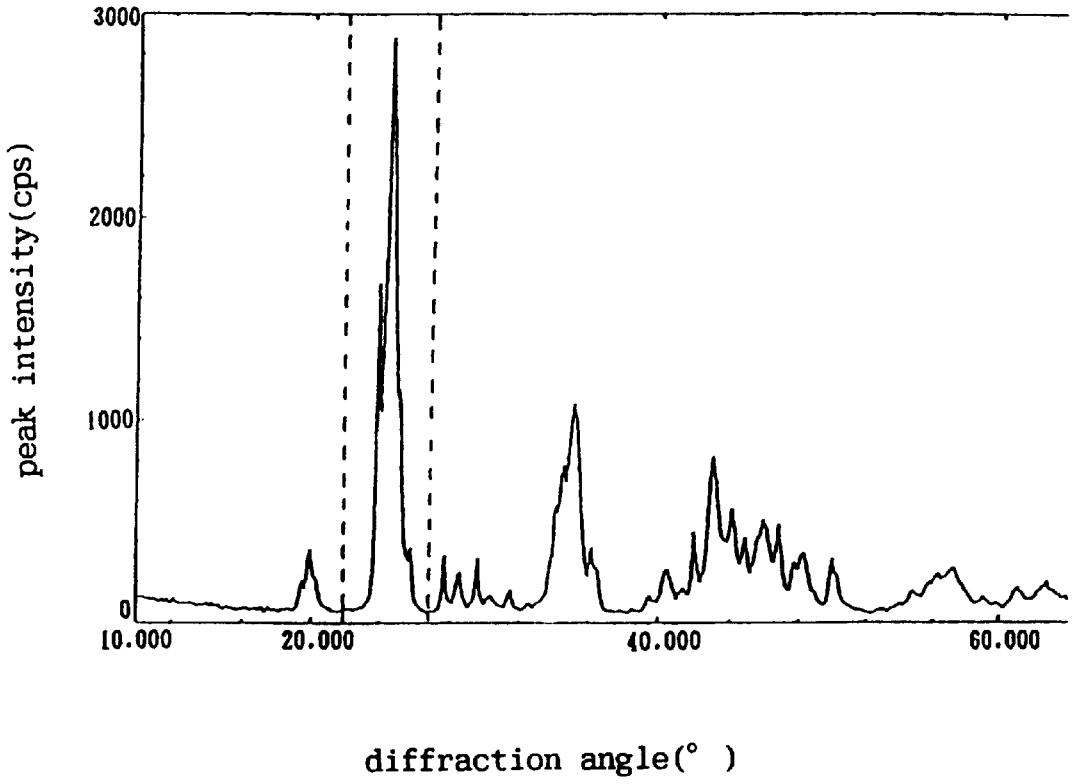
FIG. 4 is a diagram illustrating an X-ray diffraction pattern of the mixed carbonate C that is a material for the cathode of the first example of the present invention.

A part of crystalline particles of the mixed carbonate A, B and C are respectively sampled and analyzed by the X-ray diffraction analysis as in the prior art so that the diffraction patterns shown in FIG. 2, FIG. 3, and FIG. 4 were obtained. As shown in FIG. 2, unlike the prior art (FIG. 18) the diffraction pattern of the mixed carbonate A was observed to have two peaks in the interplanar spacing ranging from 0.33 nm to 0.40 nm or in the diffraction angle ranging from 22 to 27° (the part between the two dotted lines in FIG. 2). As shown in FIG. 3, unlike the prior art (FIG. 18), the diffraction pattern of the mixed carbonate B was observed to have three peaks in the interplanar spacing ranging from 0.33 nm to 0.40 nm or in the part of diffraction angle ranging from 22 to 27° (the part between the two dotted lines in FIG. 2). As shown in FIG. 4, unlike the prior art (FIG. 18), the diffraction pattern of the mixed carbonate C was observed to have four peaks in the spacing ranging from 0.33 nm to 0.40 nm or in the diffraction angle ranging from 22 to 27° (the part between the two dotted lines in FIG. 4).

Then, yttrium oxide was added into the mixed carbonate A, B and C in an amount of 630 wt.ppm respectively to make mixtures. Then, these mixtures were dispersed into a solution in which a small amount of nitrocellulose (in an amount of 5–30 grams with respect to one liter of the mixing medium) was added into the mixing medium containing diethyl oxalate and diethyl acetate (the volume ratio of diethyl oxalate and diethyl acetate was 1:1) to make a dispersed solution. This dispersed solution was coated onto the cathode base to approximately 50 $\mu$m thickness by means of a spray gun and thermally decomposed in a vacuum at a temperature of 930° C., thus making the cathode having an emitter comprising an alkaline earth metal oxide as shown in FIG. 1.

Figure 5:
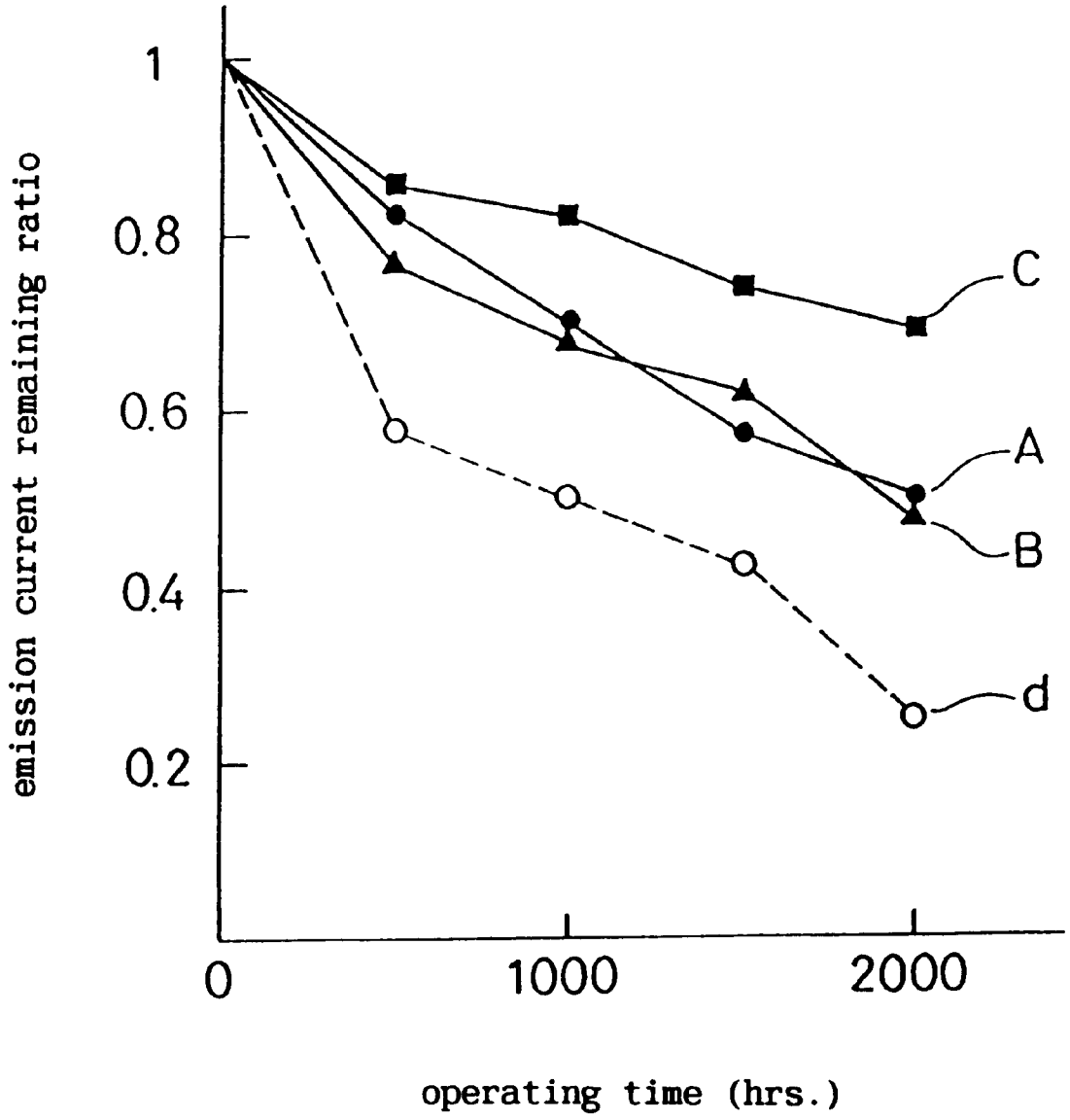
FIG. 5 is a graph illustrating the relationship between the operating time and the emission current remaining ratio of the cathodes using respectively the mixed carbonate A, B, C of the first example of the present invention and the cathode of the prior art 1.

The life test of each produced cathode was carried out at the current density of 3A/cm$^2$. The relationship between the operating time and the emission current remaining ratio is shown in FIG. 5. In FIG. 5, line A represents the relationship when the mixed carbonate A was employed; line B represents the relationship when the mixed carbonate B was employed; line C represents the relationship when the mixed carbonate C was employed; and line d represents the relationship when the binary carbonate used in the example of the prior art (hereinafter prior art 1) was employed. As is apparent from FIG. 5, when the mixed carbonate A and B were employed, the emission current remaining ratios of the two carbonate were respectively improved. The ratio was doubled from 0.25 in the prior art 1 to approximately 0.5 at 2000 hours in this embodiment of the present invention. Moreover, in the case where the carbonate C was employed, the current remaining ratio was 0.68 at 2000 hours, that is, approximately 2.5 times as large as the prior art 1. Thus, higher current density could be obtained as compared with the prior art 1. Therefore, a larger screen, higher brightness and higher resolution could be realized in the CRT by employing the mixed carbonate A, B and C for the emitter materials.

Figure 6:
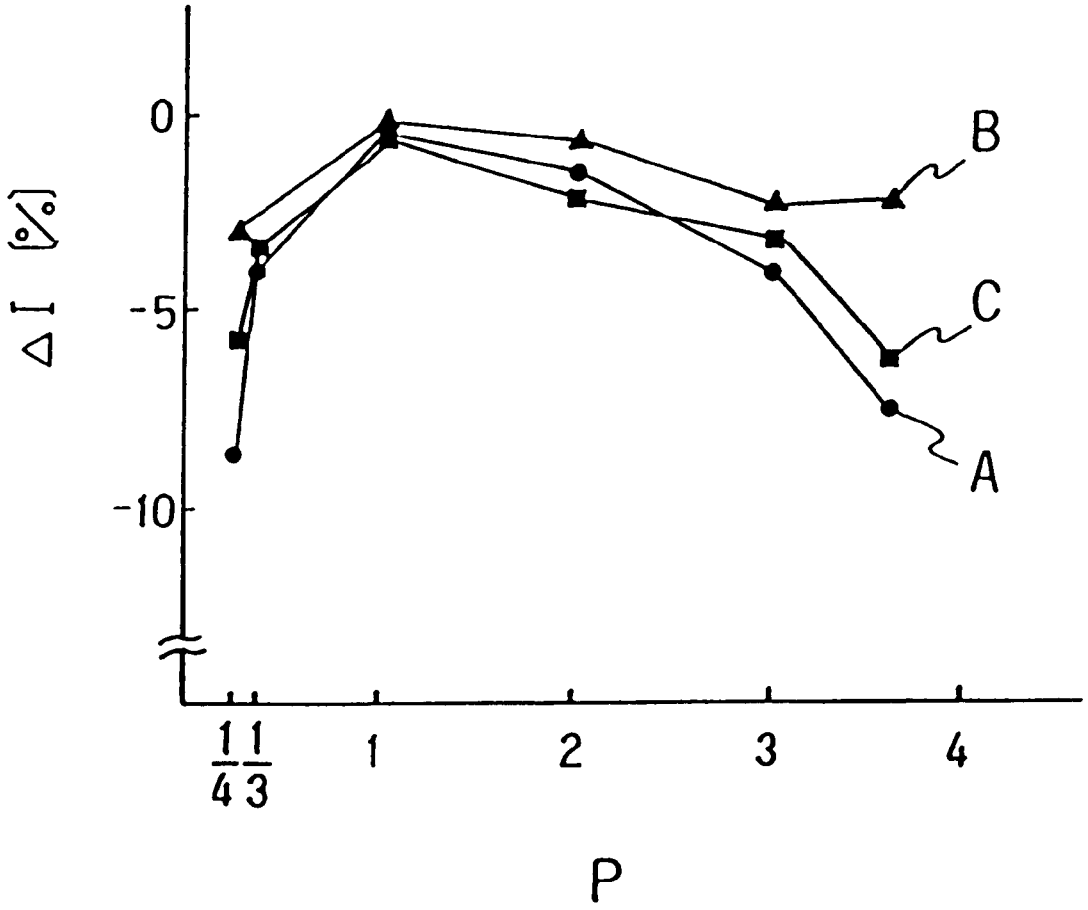
FIG. 6 is a graph illustrating the relationship between P and the emission slump of the first example of the present invention.

The average particle size of $BaCO_3$ or $SrCO_3$ dispersed in the binary carbonate in the mixed carbonate A, B and C was varied to thus make various kinds of alkaline earth metal carbonate. The produced alkaline earth metal carbonate were used as an emitter for the CRT as mentioned above and then the initial emission characteristic was measured at the current density of 3A/cm$^2$. The resulting relationship between the average particle size and the emission slump is shown in FIG. 6. As the following equation (1), the emission slump ΔI herein represents the ratio (%) of the initial emission current value I(0) with respect to the difference between the emission current value I(5) measured after five minutes and I(0). In general, the allowed value for the rate ΔI was within ±5%.

$$\Delta I=(I(5)-I(0))/I(0)\times 100 \quad (1)$$

In FIG. 6, line A represents the case where the mixed carbonate A was employed; line B represents the case where the mixed carbonate B was employed; and line C represents the case where the mixed carbonate C was employed. In FIG. 6, P represents the ratio of the average particle size of $BaCO_3$ or $SrCO_3$ with respect to the average particle size of the binary carbonate. As is apparent from FIG. 6, the emission slump of the mixed carbonate A, B and C has a correlation with the average particle size of the dispersed $BaCO_3$ or $SrCO_3$. Moreover, the emission slump became the minimum value when the average particle size of dispersed $BaCO_3$ or $SrCO_3$ was the same size as that of mixed crystal or solid solution. The emission slump was within the allowed value when the average particle size of dispersed $BaCO_3$ or $SrCO_3$ was one-third to three times as large as that of mixed crystal and solid solution. Consequently, from the viewpoint of the emission slump, the average particle size of $BaCo_3$ or $SrCO_3$ dispersed in the binary carbonate is preferably in the range of approximately one-third to three times as much as the average particle size of the binary carbonate. In addition, the average particle size of the binary carbonate differs depending on the synthesizing method, many of them fall within the range of 2–5 $\mu$m. ΔI was at a minimum when P was around 1. Consequently, the binary carbonate having the particle size ranging from 2 to 5 $\mu$m, the same particle size as that of $BaCO_3$ and $SrCO_3$, was the most effective in terms of the emission slump.

Figure 7:
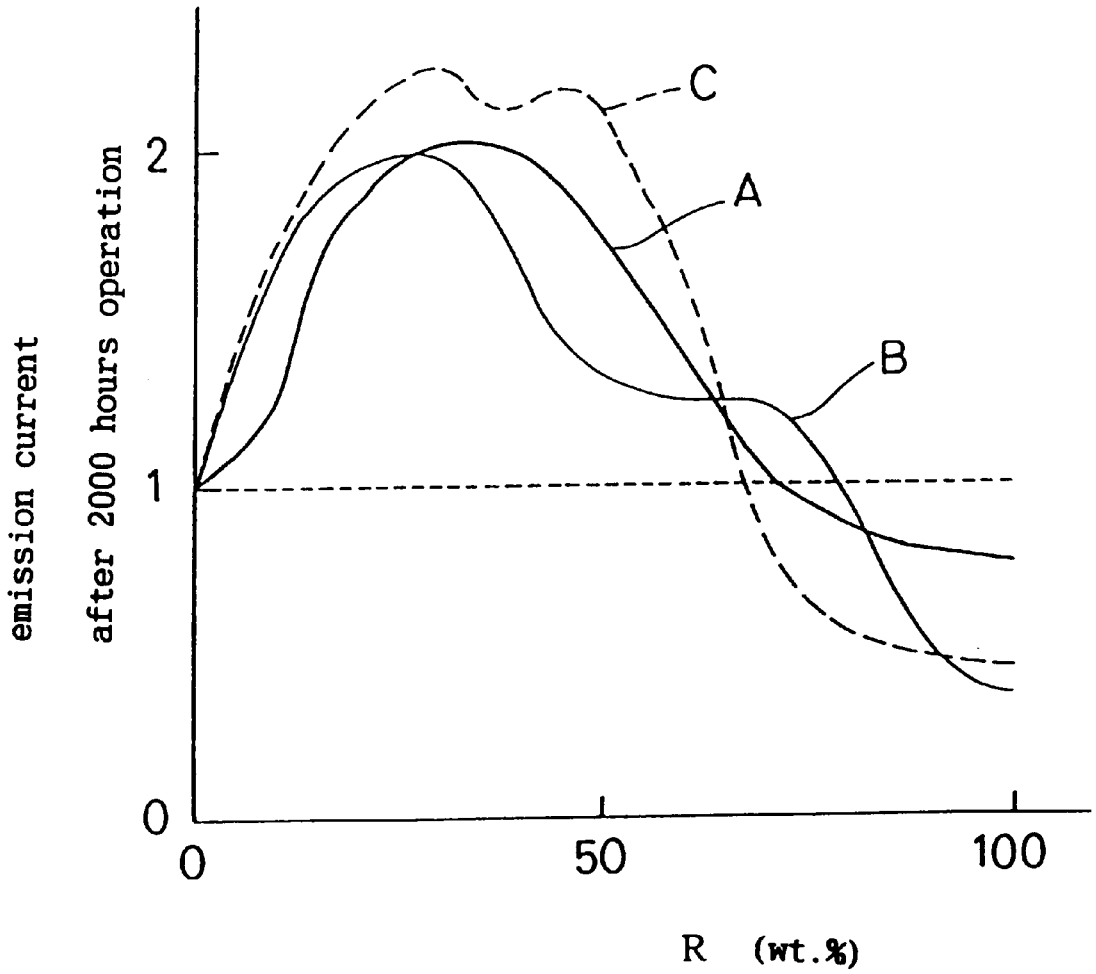
FIG. 7 is a graph illustrating the corelation between R and the emission current of the first example of the present invention.

The mixing ratio of $BaCO_3$ or $SrCO_3$ to the binary carbonate in mixed carbonate A, B and C was varied to thus make various kinds of alkaline earth metal carbonate. The produced alkaline earth metal carbonates were used as an emitter for the CRT in the same method as mentioned above. The life test of the alkaline earth metal carbonate was conducted at the current density of 3A/cm$^2$. The resulting relationship between the mixing ratio and the emission current at 2000 hours is shown in FIG. 7. In FIG. 7, R represents in the mixed carbonate A the value of the weight of mixed $BaCO_3$ divided by the weight of the entire mixed carbonate, and in the mixed carbonate B the value of the weight of mixed $SrCO_3$ divided by the weight of the entire mixed carbonate. R, in the mixed carbonate C, represents the value of the total weight of $BaCO_3$ and $SrCO_3$ divided by the weight of the entire mixed carbonate. The emission current denotes the value (current ratio) of the emission current after 2000 hours of the operation normalized by that of the prior art after 2000 hours of the operation of the prior art. In FIG. 7, line A represents the case where the mixed carbonate A was employed; line B represents the case where the mixed carbonate B was employed; and line C represents the case where the mixed carbonate C was employed.

As is apparent from FIG. 7, the emission current had the maximum value when the mixing ratios of both mixed carbonate A and B became approximately 30 wt. %. Moreover, if even a small amount of $BaCO_3$ or $SrCO_3$ was mixed, the improved emission could be obtained versus the prior art 1. On the contrary, when the mixing ratio was above 70 wt. %, the emission current unpreferably became smaller than the prior art 1. Therefore, the mixing ratio of $BaCO_3$ and $SrCO_3$ should be less than 70 wt. %.

EXAMPLE 2

Referring now to the figures, there is illustrated the second embodiment of the present invention.

Figure 19:
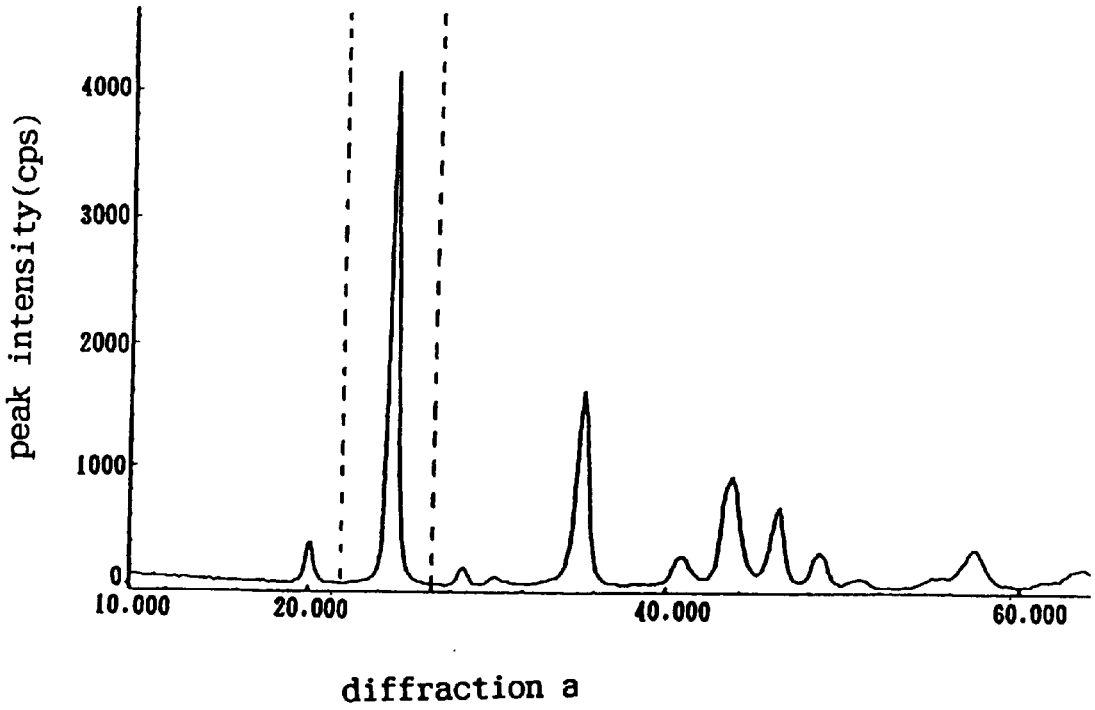
FIG. 19 is a diagram illustrating an X-ray diffraction pattern of the ternary alkaline earth metal carbonate that is a material for the cathode of the prior art 2.
Figure 20:
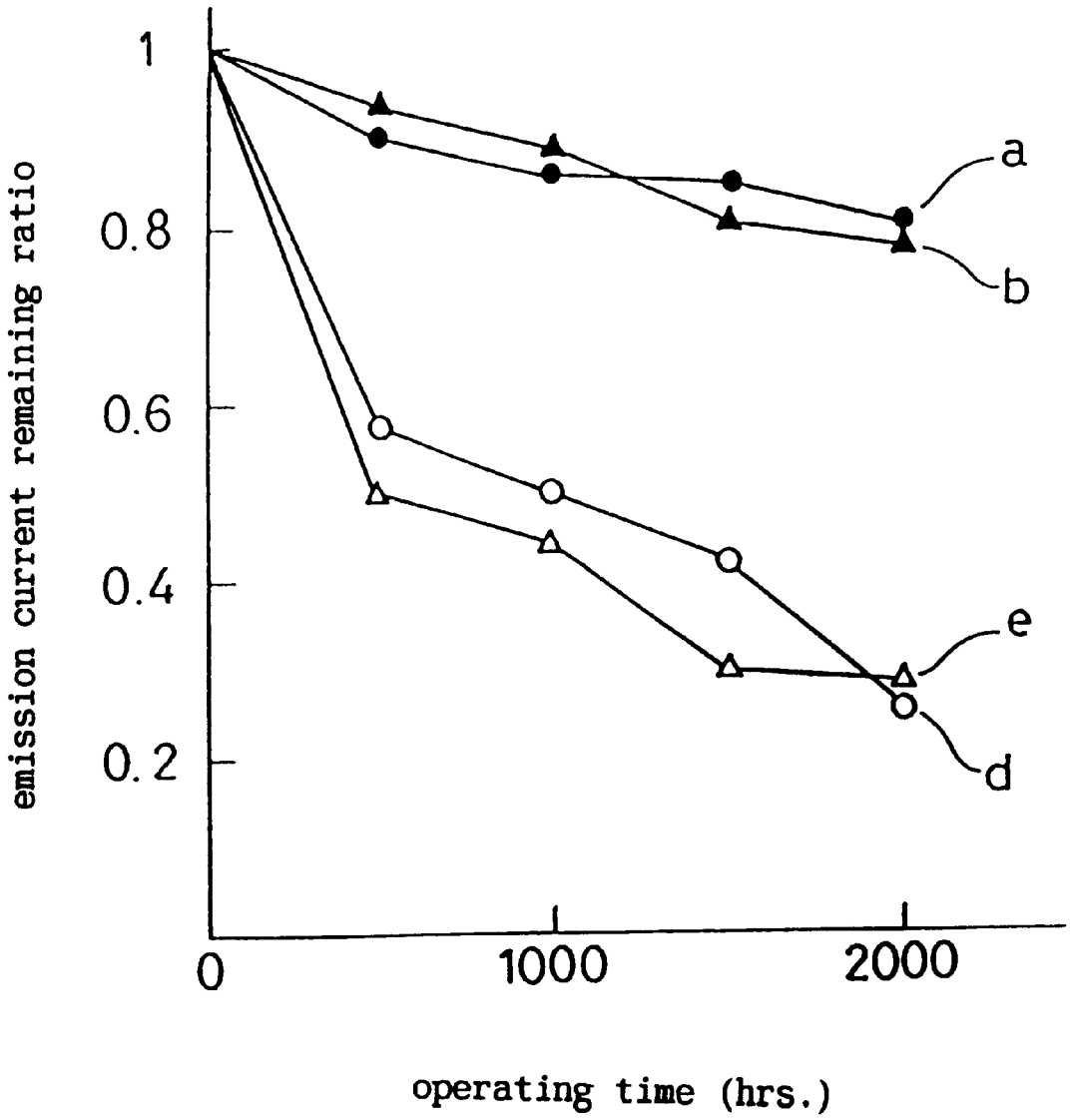
FIG. 20 is a graph illustrating the relationship between the operating time and the emission current remaining ratio of the prior art materials.

Ternary carbonate, which was synthesized by the sodium carbonate precipitation method and shows the X-ray diffraction pattern as shown in FIG. 19, and $BaCO_3$ were mixed at a weight ratio of 2:1, thus making a mixed carbonate D.

The above mentioned ternary carbonate was obtained through the following steps of: dissolving 4.8 kilograms of barium nitrate and 3.8 kilograms of strontium nitrate and 0.75 kilograms of calcium nitrate in 100 liter of hot water at a temperature of 80° C. (This aqueous solution is designated "solution Y" for ease of reference.); dissolving 8 kilograms of sodium carbonate in 35 liter of hot water at a temperature of 80° C. (This aqueous solution is designated "solution Z" for ease of reference); stirring the solution Y and keeping it at the temperature of 80° C.; adding the solution Z into the solution Y at the adding rate of 2 liters per one minute by the use of a pump to form a precipitation of (Ba, Sr, Ca)$CO_3$; taking out this carbonate by the centrifugal method; and then drying this carbonate at a temperature of 140° C.

A part of the crystalline particles of the mixed carbonate D was sampled and analyzed by the X-ray diffraction analysis as mentioned above, and a diffraction pattern that was the same as that shown in FIG. 2 could be obtained. As shown in FIG. 2, the diffraction pattern of the mixed carbonate A was observed to have two peaks in the spacing ranging from 0.33 nm to 0.40 nm.

Figure 8:
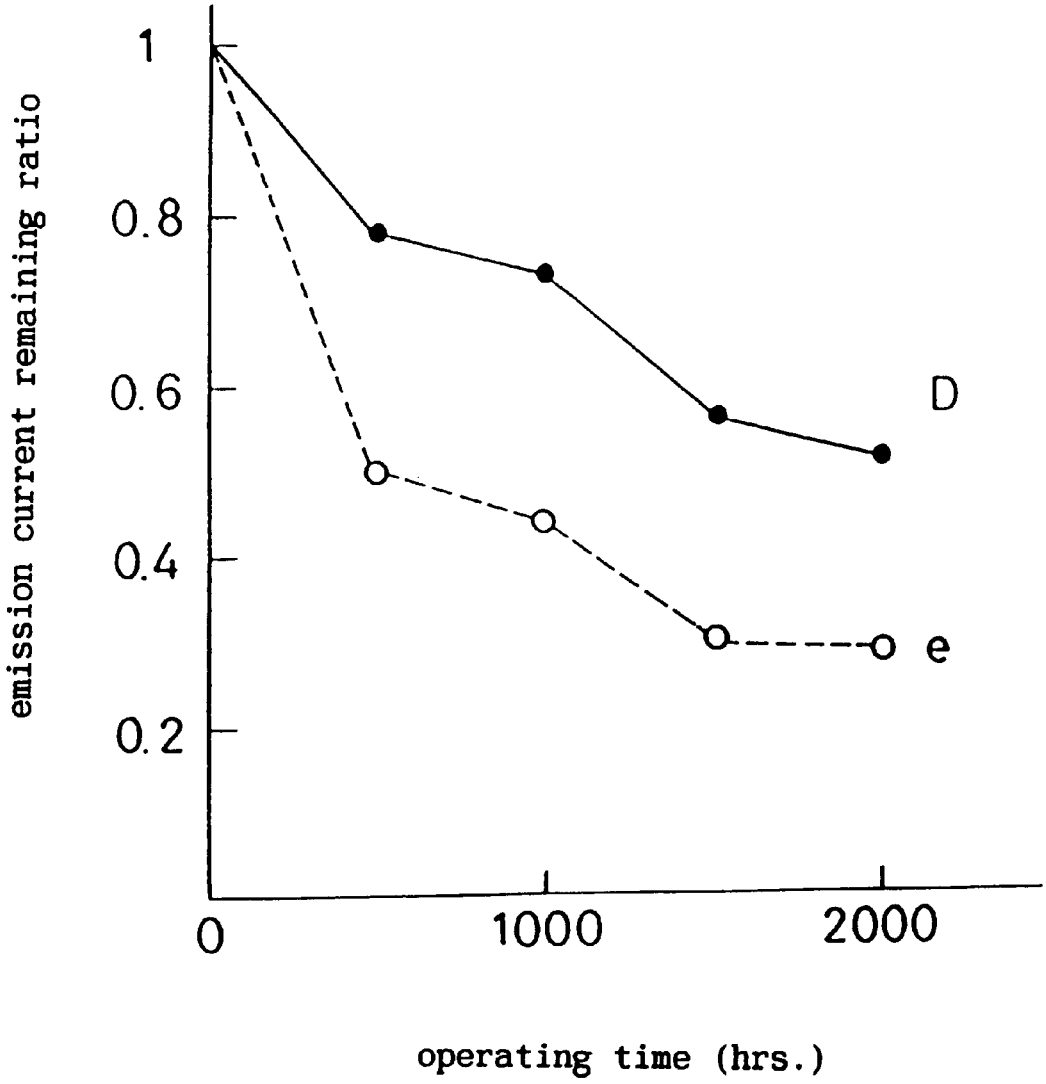
FIG. 8 is a graph illustrating the relationship between the operating time and the emission current remaining ratio of the cathodes of the second example of the present invention and the prior art 2.

Then, yttrium oxide was added into the mixed carbonate D in an amount of 630 wt.ppm to make a mixture. This mixture was used as an emitter for the CRT. A life test of this mixture was conducted at the current density of $3A/cm^2$. The relationship between the operating time and the emission current remaining ratio was obtained as shown in FIG. 8. In FIG. 8, line D represents the relationship when the mixed carbonate D was employed; and line e represents the ternary carbonate used in the example of the prior art (hereinafter prior art 2). As is apparent from FIG. 8, when the mixed carbonate D was employed, the emission current remaining ratio was improved. The ratio was doubled from 0.25 in the prior art 2 to approximately 0.5 of this embodiment of the present invention after 2000 hours of operation. Thus, a higher current density could be obtained than the prior art 2. Therefore, a larger screen, higher brightness and higher resolution could be realized in the CRT by employing the mixed carbonate D as an emitter material. The method of mixing $BaCO_3$ into the ternary carbonate was described. However, if $SrCO_3$ was mixed into the ternary carbonate or both $BaCO_3$ and $SrCO_3$ were mixed into the ternary carbonate, a higher current density could be realized as with the above mentioned carbonate B and C. If the average particle size of mixed $BaCO_3$ and $SrCO_3$ was in the range from one-third to three times as large as the average particle size of the ternary carbonate, the emission slump could stay within ±5% as in the first example mentioned above. Moreover, the mixing ratio of $BaCO_3$ or $SRCO_3$ to the ternary carbonate was varied, to thus make various kinds of alkaline earth metal carbonate. These various mixtures were used as emitters for the CRT, and life tests of these mixtures were conducted at the current density of $3A/cm^2$ as with the above mentioned method. In the relationship between the mixing ratio and emission current, the shapes of the curves were different from those of the above-mentioned mixed carbonates A, B and C (FIG. 7). When R was around 30 wt. %, the emission current became maximum. However, when R was above 60 wt. %, the emission current unpreferably became smaller than the prior art 2. Therefore, it is preferable that the ratio of mixing $BaCO_3$ and $SrCO_3$ into the ternary carbonate, whether in the case of mixing only $BaCO_3$ into the ternary carbonate, or in the case of mixing $BaCO_3$ and $SrCO_3$ into the ternary carbonate, is less than 60 wt. %.

EXAMPLE 3

Referring now to figures, there is illustrated the third embodiment of the present invention.

Figure 9:
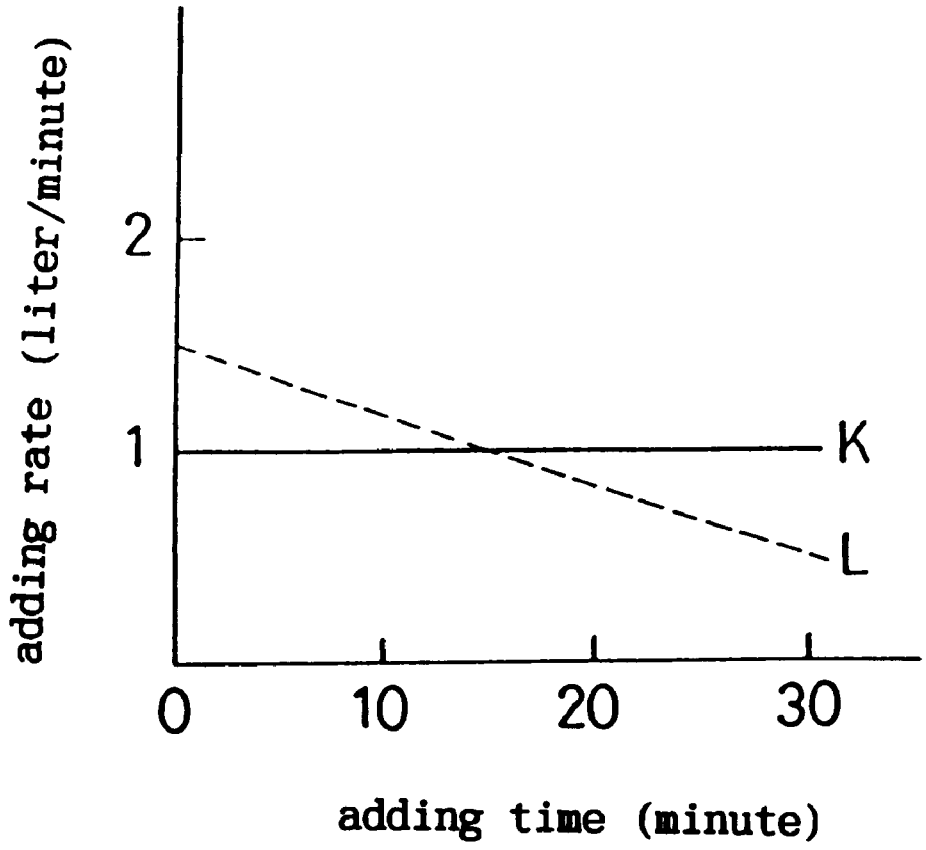
FIG. 9 is a graph illustrating the change in the adding time with respect to the adding rate of barium nitrate aqueous solution (K) and strontium nitrate aqueous solution (L) when alkaline earth metal carbonate (carbonate E) is synthesized according to the third example of the present invention.
Figure 10:
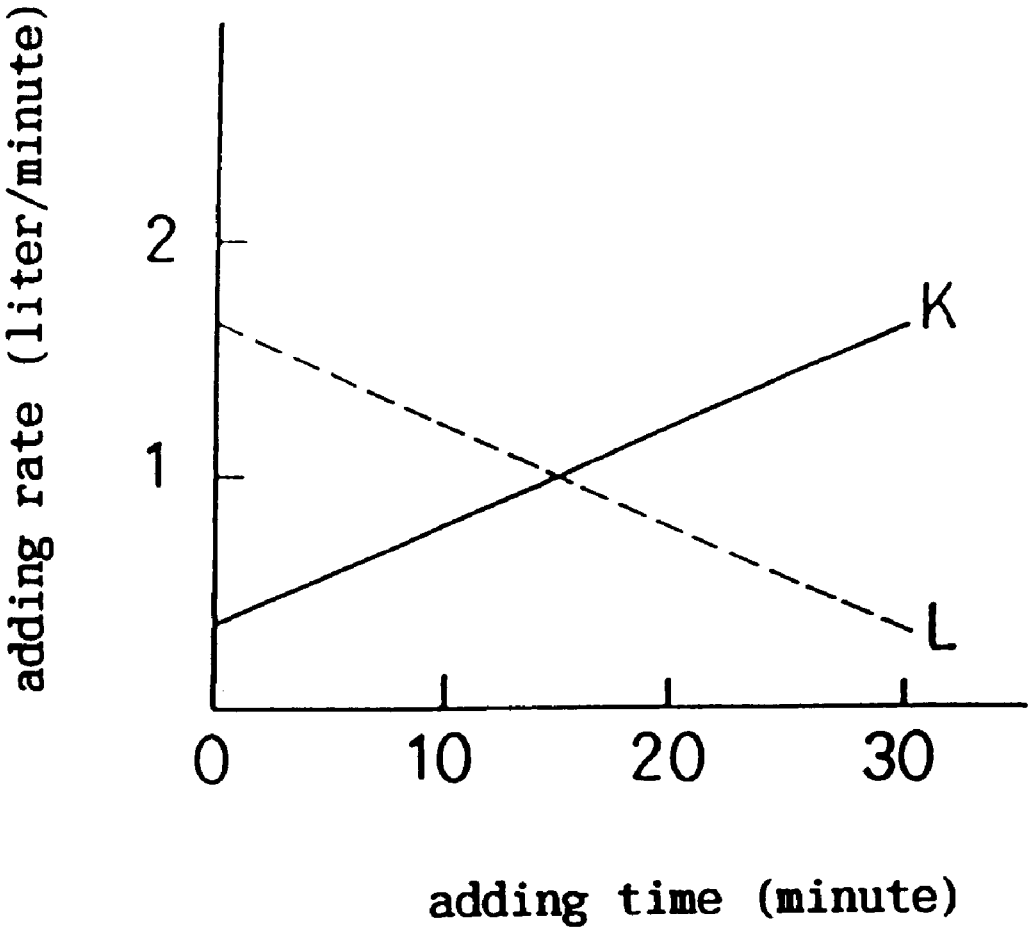
FIG. 10 is a graph illustrating the change in the adding time with respect to the adding rate of barium nitrate aqueous solution (K) and strontium nitrate aqueous solution (L) when alkaline earth metal carbonate (carbonate F) is synthesized in the third example of the present invention.
Figure 11:
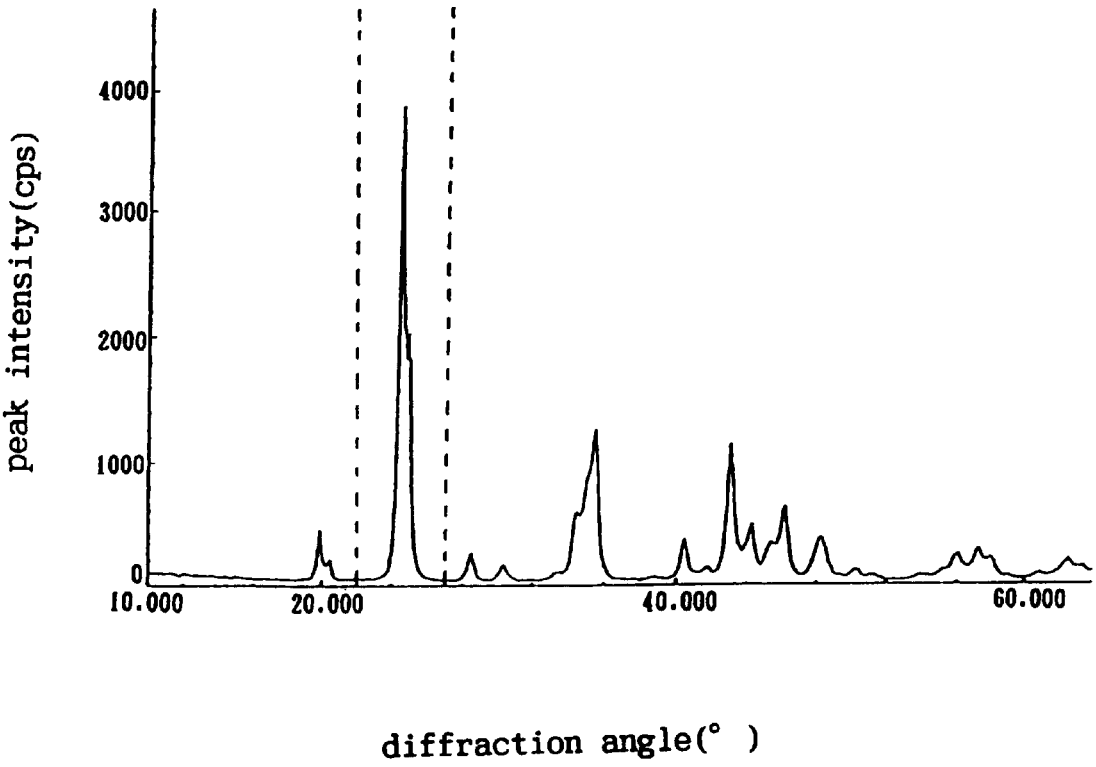
FIG. 11 is a diagram illustrating an X-ray diffraction pattern of the carbonate E that is a material for the cathode of the third example of the present invention.
Figure 12:
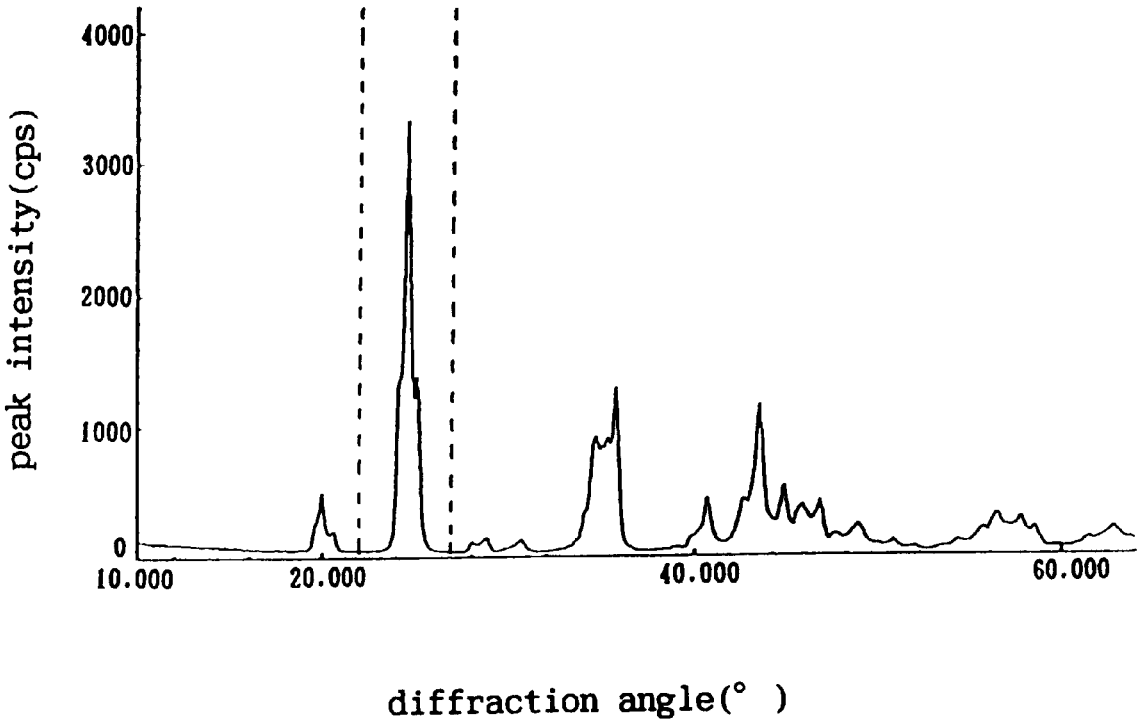
FIG. 12 is a diagram illustrating an X-ray diffraction pattern of the carbonate F that is a material for the cathode of the third example of the present invention.

Barium nitrate, strontium nitrate and sodium carbonate were respectively dissolved into pure water to make barium nitrate aqueous solution (K), strontium nitrate aqueous solution (L) and sodium carbonate aqueous solution (N). All of the concentrations of the above mentioned K, L and N were controlled to be 0.5 mol/liter. Then, barium nitrate aqueous solution (K) and strontium nitrate aqueous solution (L) at temperatures of 80° C. were added in an amount of 30 liters each into 60 liters of sodium carbonate aqueous solution (N) that was heated to 80° C., at different adding rates, thus making a precipitate of alkaline earth metal carbonate. In this example, the synthesizing reaction was carried out at two types of adding rates (K and L) as shown in FIG. 9 and FIG. 10. As is apparent from FIG. 9, in the first type of adding rate, the adding rate of K was constant and the adding rate of L was gradually decreased. The alkaline earth metal carbonate comprising barium carbonate and strontium carbonate which was synthesized at the adding rate shown in FIG. 9 is designated carbonate E. As is apparent from FIG. 10, for the second type of adding rate, the adding rate of K was gradually increased and the adding rate of L was gradually decreased. The alkaline earth metal carbonate comprising barium carbonate and strontium carbonate which was synthesized at the adding rate shown in FIG. 10 is designated carbonate F. A part of crystalline particles of the carbonate E and F were respectively sampled and analyzed by X-ray diffraction analysis as with the method mentioned above, and the diffraction patterns shown in FIG. 11 and FIG. 12 were obtained. As shown in FIG. 11, the diffraction pattern of the carbonate E was observed to have two peaks in the diffraction angle ranging from 22 to 27°, unlike the prior art (FIG. 18). As shown in FIG. 12, the diffraction pattern of the carbonate F was observed to have three peaks in the diffraction angle ranging from 22 to 27°, unlike the prior art (FIG. 18).

Figure 13:
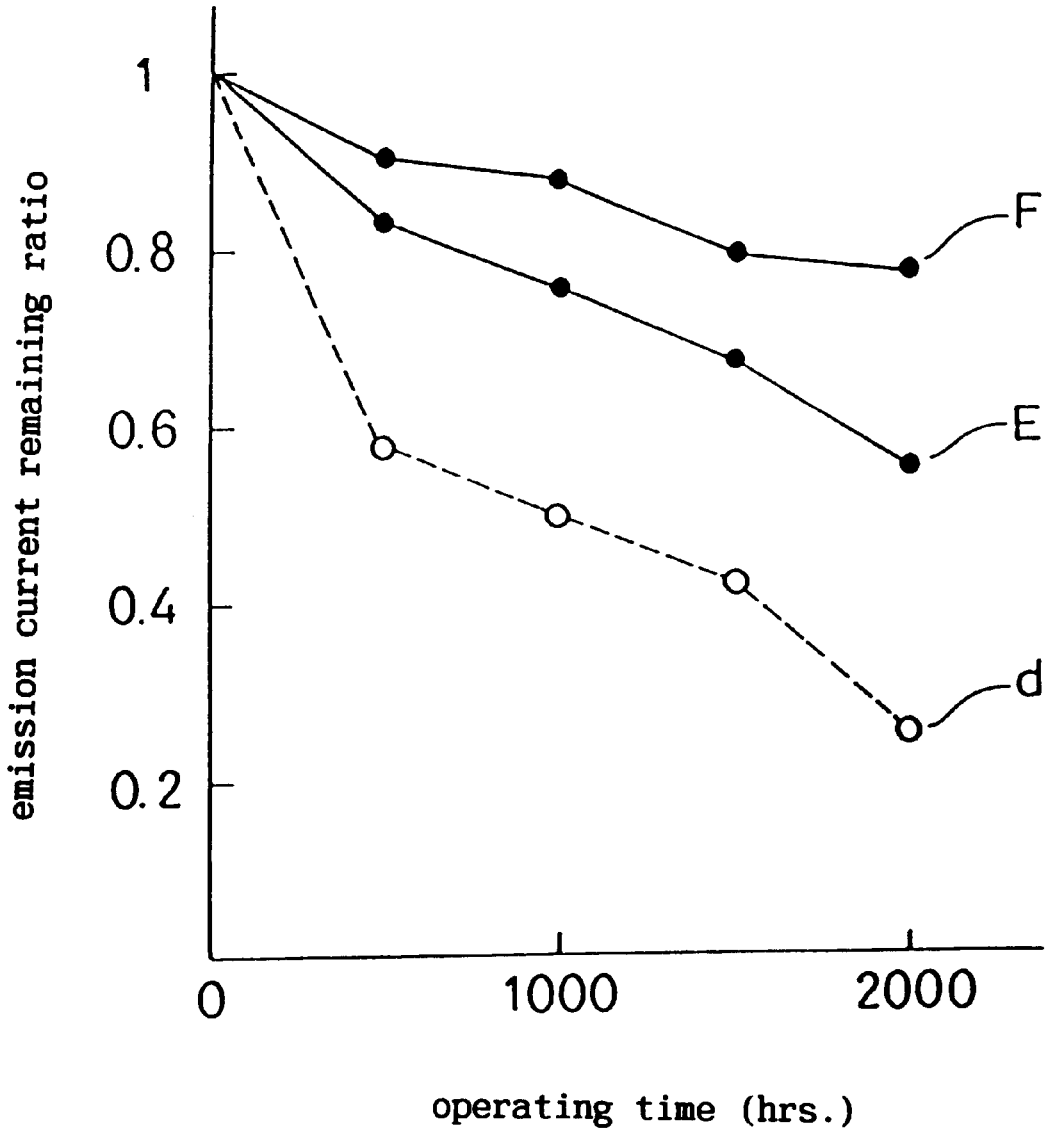
FIG. 13 is a graph illustrating the relationship between the operating time and the emission current remaining ratio of the cathodes using the carbonate E, F of the third example of the present invention and the prior art 1.

Then, yttrium oxide was added into the carbonate E and F in an amount of 630 wt.ppm respectively to make mixtures. These mixtures were used as emitters for the CRT as with the above-mentioned method and life tests of these emitters were conducted at the current density of $3A/cm^2$. The relationship between the operating time and the emission current remaining ratio was shown in FIG. 13. In FIG. 13, a line E represents the relationship when the mixed carbonate E was employed; a line F represents the relationship when the mixed carbonate F was employed; and line d represents the case of the prior art 1. As is apparent from FIG. 13, when the carbonate E was employed, the emission current remaining ratio of the carbonate was improved to 0.55 at 2000 hours. The ratio at 2000 hours was doubled from 0.25 in the prior art to approximately 0.5. On the other hand, when the carbonate F was employed, the emission current remaining ratio of the carbonate was improved to 0.78, which was three times as large as the prior art. Therefore, a larger screen size, higher brightness and higher resolution could be realized in the CRT by employing the carbonate E and F for an emitter material.

Figure 14:
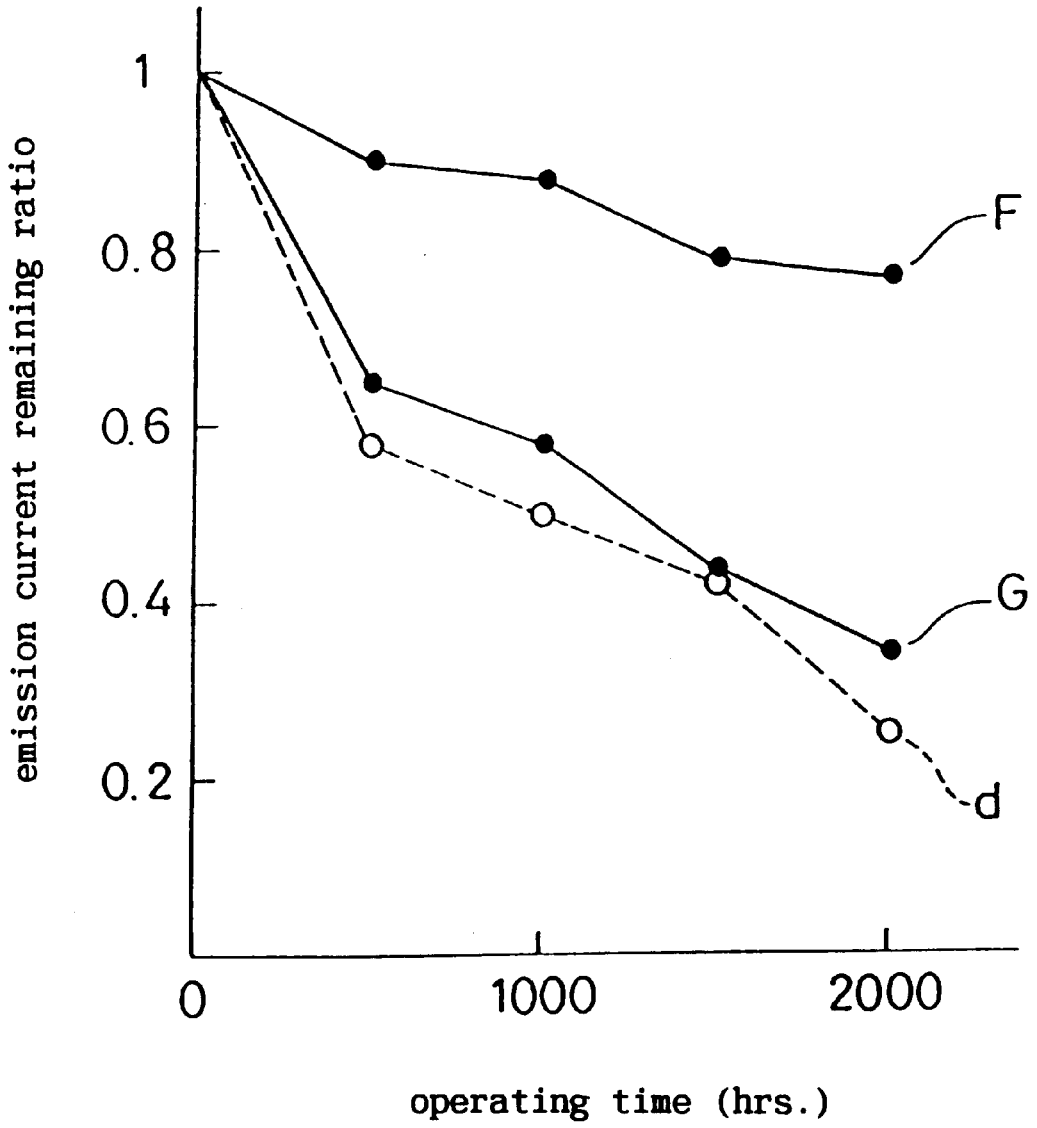
FIG. 14 is a graph illustrating the relationship between the operating time and the emission current remaining ratio of the cathode using the carbonate F and G of the third example of the present invention and the prior art 1.

Then, the same life test was conducted when no yttrium oxide was added into the carbonate F at the current density of $3A/cm^2$. The result is shown in FIG. 14. In FIG. 14, line F represents the case where 630 ppm of yttrium oxide was added into carbonate F; line G represents the case where no yttrium was added into the carbonate F; and line d represents the case of the prior art 1. As is apparent from FIG. 14, for example, after 2000 hours of operation, the emission current remaining ratio of the carbonate F and G improved as compared with the prior art 1, regardless of the presence of yttrium oxide. In particular when yttrium oxide was added, the highest emission current remaining ratio could be obtained. Therefore, it is preferable that rare earth metal oxide such as yttrium oxide or the like is added. However, even if yttrium oxide was not added, higher emission characteristics could be obtained than the prior art 1.

EXAMPLE 4

Referring now to the figures, there is illustrated the fourth embodiment of the present invention.

Figure 15:
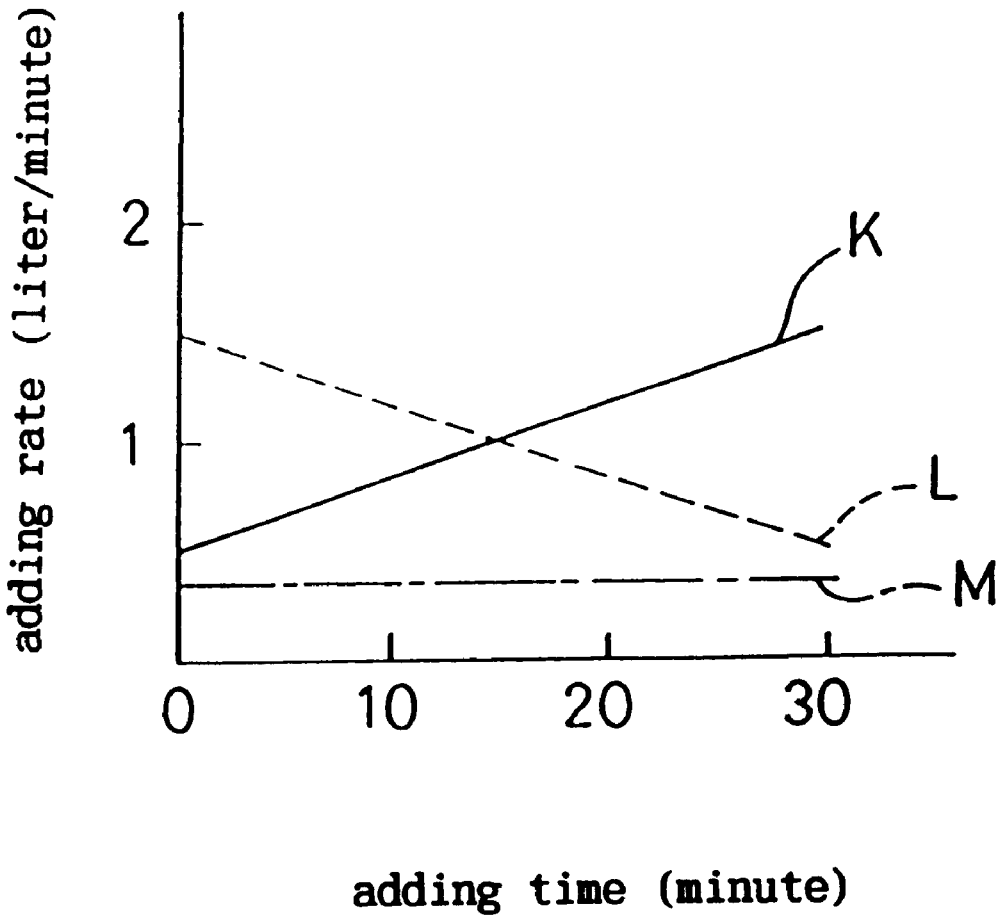
FIG. 15 is a graph illustrating the change in the adding time with respect to the adding rate of barium nitrate aqueous solution (K), strontium nitrate aqueous solution (L) and calcium nitrate aqueous solution (M) when alkaline earth metal carbonate (carbonate H) is synthesized according to the fourth example of the present invention.
Figure 16:
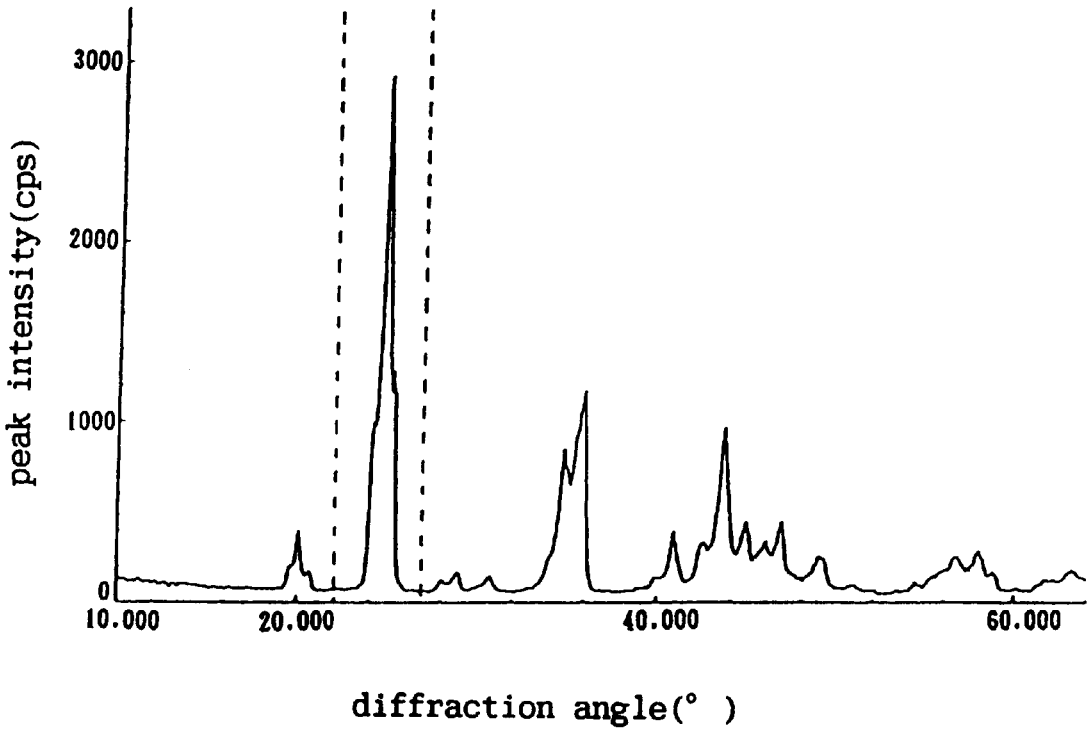
FIG. 16 is a diagram illustrating an X-ray diffraction pattern of the carbonate H that is a material for the cathode of the fourth example of the present invention.

Barium nitrate, strontium nitrate, calcium nitrate and sodium carbonate were respectively dissolved into pure water to make respectively barium nitrate aqueous solution (K), strontium nitrate aqueous solution (L), calcium nitrate aqueous solution (M) and sodium carbonate aqueous solution (N). All of the concentration of the above mentioned K, L, M and N were controlled to be 0.5 mol/liter. Then, 30 liter of barium nitrate aqueous solution (K), 30 liter of strontium nitrate aqueous solution (L) and 10 liter of calcium nitrate aqueous solution (M) of temperatures of 80°C. were added into 70 liter of sodium carbonate aqueous solution (N) that had been heated to 80° C. at different addition rates, thus making a precipitate of alkaline earth metal carbonate. In this synthesizing reaction, the adding rates of K, L, and M are shown in FIG. 15. As is apparent from FIG. 15, the adding rate of K was gradually increased, L was gradually decreased and M was constant. The alkaline earth metal carbonate comprising barium carbonate, strontium carbonate and calcium carbonate synthesized at the adding rate shown in FIG. 15 is designated carbonate H. A part of crystalline particles of the carbonate H was sampled and analyzed by X-ray diffraction analysis in the manner mentioned above, and the diffraction pattern shown in FIG. 16 was obtained. As shown in FIG. 16, the diffraction pattern of the carbonate H was observed to have three peaks in the diffraction angle ranging from 22 to 27° unlike the prior art (FIG. 19).

Figure 17:
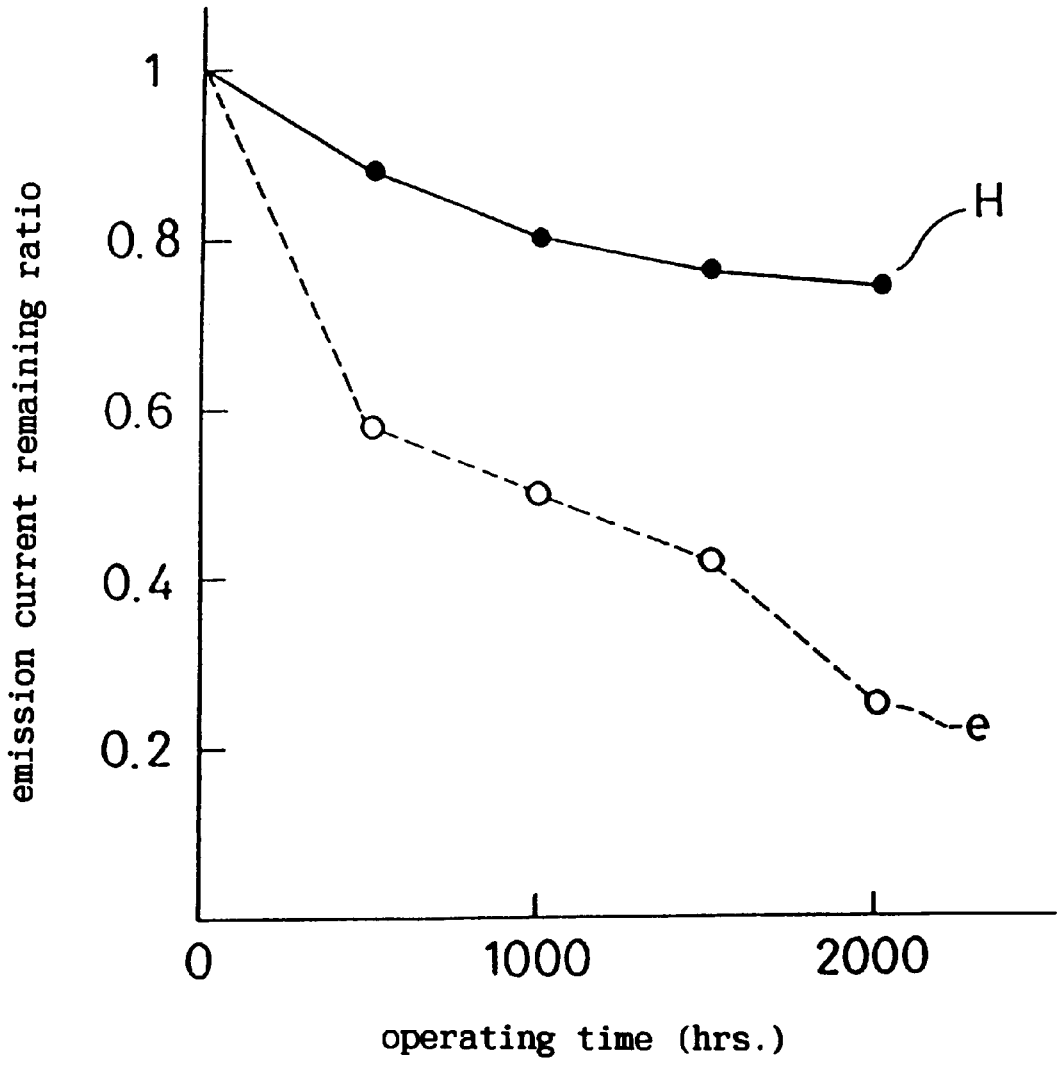
FIG. 17 is a graph illustrating the relationship between the operating time and the emission current remaining ratio of the cathode using carbonate H of the fourth example and the prior art 2.

Then, yttrium oxide was added into the carbonate H in an amount of 630 wt.ppm to make a mixture. The mixture was used as an emitter for the CRT as with the above-mentioned method. The life test of this mixture was conducted at the current density of 3A/cm$^2$. The relationship between the operating time and the emission current remaining ratio was shown in FIG. 17. In FIG. 17, line H represents the relation when the mixed carbonate H was employed; and line e represents the case of the prior art 2. As is apparent from FIG. 17, the emission current remaining ratio of the carbonate H was improved by three times as large as the prior art 2 at 2000 hours of operation. Therefore, a larger screen size, higher brightness and higher resolution could be realized in the CRT by employing carbonate H for an emitter material According to the above-mentioned result of each embodiment, the present invention can provide an emitter material for the CRT that shows an excellent emission life characteristic under the operating condition of a high current density of 3A/cm$^2$ by dispersing or separating at least one kind of above-mentioned alkaline earth metal carbonate into the mixed crystal or solid solution comprising at least two kinds of alkaline earth metal carbonate. It is more effective that rare earth-metal oxide is further included therein. In the first to fourth embodiments, the method of using yttrium oxide was described, but in the case of employing europium oxide or scandium oxide, the same effect could be obtained. Furthermore, in the case of any of rare earth metal, rare earth metal oxide or rare earth metal carbonate being used, almost the same effect can be obtained. In addition, it is possible to contain rare earth metal in the crystalline particles of alkaline earth metal carbonate by the coprecipitation method. Adding rare earth metal into alkaline earth metal carbonate by this method is also effective. In particular, when as a rare earth metal element yttrium was mixed into an emitter material in an amount of 550–950 ppm with respect to the number of alkaline earth metal atoms, the same effect as mentioned above could be obtained. Also, the thermal decomposition temperature could be decreased by approximately 100° C. as compared with the case where no rare earth metal element was added. Thus, thermal decomposition time can be reduced and the manufacturing cost can also be reduced.

Moreover, in the above-mentioned first to fourth embodiments, the embodiment using the alkaline earth metal carbonate synthesized by the sodium carbonate precipitation method was described. However, the same result could be obtained by using alkaline earth metal carbonate synthesized by the ammonium carbonate precipitation method.

Moreover, the X-ray diffraction pattern in the area of interplanar spacing ranging from 0.33 nm to 0.40 nm has two peaks or more so that the emitter materials for the CRT with a good emission characteristic can be selected. Consequently, making the CRT is not required to evaluate the emission characteristic of the emitter material so that the manufacturing cost can be reduced.

As stated above, the emitter materials for the CRT of the present invention comprise mixed crystal or solid solution of at least two kinds of alkaline earth metal carbonate In the above-mentioned mixed crystal or solid solution, at least one alkaline earth metal carbonate is dispersed or separated. Consequently, the emitter can have a sufficient lifetime even under the condition of the current density of the 2A/cm$^2$ and moreover the emitter materials for the CRT, which are proper materials for a larger screen size, high brightness, and high resolution, can be realized.

In addition, according to the method for manufacturing an emitter material for the CRT of the present invention, the above-mentioned emitter materials for the CRT can be manufactured effectively by adding at least two kinds of nitrate carbonate aqueous solution into the aqueous solution comprising carbonic acid ion individually at different adding rates.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. An emitter material for a cathode ray tube comprising a mixed crystal or solid solution of at least two kinds of alkaline earth metal carbonate, and at least one alkaline earth metal carbonate dispersed in said mixed crystal or solid solution, wherein the at least one alkaline earth metal carbonate is dispersed as crystalline particles in particles of said mixed crystal or solid solution, and the average particle size of said crystalline particles is not less than one-third nor more than three times as large as the average particle size of the particles of said mixed crystal or solid solution.

2. The emitter material for a cathode ray tube according to claim 1, wherein the at least one alkaline earth metal carbonate is dispersed as crystalline particles in particles of said mixed crystal or solid solution and the average size of said dispersed crystalline particles is in the range from 2 to 5 $\mu$m.

3. The emitter material for a cathode ray tube according to claim 1, which has an X-ray diffraction pattern for alkaline earth metal carbonate with two peaks or more in the interplanar spacing ranging from 0.33 nm to 0.40 nm.

4. The emitter material for a cathode ray tube according to claim 1, wherein the at least two kinds of alkaline earth metal carbonate for the mixed crystal or solid solution comprise barium carbonate and strontium carbonate.

5. The emitter material for a cathode ray tube according to claim 4, wherein alkaline earth metal carbonate comprising barium carbonate and strontium carbonate is dispersed in the mixed crystal or solid solution in an amount of not less than 0.1 to less than 70 wt. %.

6. The emitter material for a cathode ray tube according to claim 1, wherein the at least two kinds of alkaline earth metal carbonate for the mixed crystal or solid solution comprise barium carbonate, strontium carbonate and calcium carbonate.

7. The emitter material for a cathode ray tube according to claim 6, wherein alkaline earth metal carbonate comprising barium carbonate, strontium carbonate and calcium carbonate is dispersed in the mixed crystal or solid solution in an amount of not less than 0.1 wt. % to less than 60 wt. %.

8. The emitter material for a cathode ray tube according to claim 1 further comprising at least one material selected from the group consisting of rare earth metal, rare earth metal oxide and rare earth metal carbonate.

9. The emitter material for a cathode ray tube according to claim 8, wherein yttrium atoms are added by a coprecipitation method in an amount of 550–950 ppm with respect to an entire amount of alkaline earth metal atoms used for forming the emitter material.

10. An emitter material for a cathode ray tube comprising a mixed crystal or solid solution of at least two kinds of alkaline earth metal carbonate, wherein at least one kind of alkaline earth metal carbonate is concentrated locally within one crystal of carbonate.

11. The emitter material for a cathode ray tube according to claim 10, which has an X-ray diffraction pattern for alkaline earth metal carbonate with two peaks or more in the interplanar spacing ranging from 0.33 nm to 0.40 nm.

12. The emitter material for a cathode ray tube according to claim 10, wherein the at least two kinds of alkaline earth metal carbonate for the mixed crystal or solid solution comprise barium carbonate and strontium carbonate.

13. The emitter material for a cathode ray tube according to claim 10, wherein the at least two kinds of alkaline earth metal carbonate for the mixed crystal or solid solution comprise barium carbonate, strontium carbonate and calcium carbonate.

14. The emitter material for a cathode ray tube according to claim 13, wherein yttrium atoms are added by a coprecipitation method in an amount of 550–950 ppm with respect to an entire amount of alkaline earth metal atoms used for forming the emitter material.

15. An emitter material for a cathode ray tube comprising a mixed crystal or solid solution of at least two kinds of alkaline earth metal carbonate, and at least one alkaline earth metal carbonate dispersed in said mixed crystal or solid solution, wherein the emitter material has an X-ray diffraction pattern for alkaline earth metal carbonate with two peaks or more in the interplanar spacing ranging from 0.33 nm to 0.40 nm.

16. The emitter material for a cathode ray tube according to claim 15, wherein the at least two kinds of alkaline earth metal carbonate for the mixed crystal or solid solution comprise barium carbonate and strontium carbonate.

17. The emitter material for a cathode ray tube according to claim 16, wherein alkaline earth metal carbonate comprising barium carbonate and strontium carbonate is dispersed in the mixed crystal or solid solution in an amount of not less than 0.1 wt. % to less than 70 wt. %.

18. The emitter material for a cathode ray tube according to claim 15, wherein the at least two kinds of alkaline earth metal carbonate for the mixed crystal or solid solution comprise barium carbonate, strontium carbonate and calcium carbonate.

19. The emitter material for a cathode ray tube according to claim 18, wherein alkaline earth metal carbonate comprising barium carbonate, strontium carbonate and calcium carbonate is dispersed in the mixed crystal or solid solution in an amount of not less than 0.1 wt. % to less than 60 wt. %.

20. The emitter material for a cathode ray tube according to claim 15, further comprising at least one material selected from the group consisting of rare earth metal, rare earth metal oxide and rare earth metal carbonate.

21. The emitter material for a cathode ray tube according to claim 15, wherein yttrium atoms are added by a coprecipitation method in an amount of 550–950 ppm with respect to an entire amount of alkaline earth metal atoms used for forming the emitter material.

* * * * *